US008771794B2

(12) United States Patent
Pollack et al.

(10) Patent No.: US 8,771,794 B2
(45) Date of Patent: Jul. 8, 2014

(54) FLOOR TREATMENT PROCEDURE

(75) Inventors: Jeffrey W. Pollack, Joliet, IL (US); John M. Hill, III, Naperville, IL (US)

(73) Assignee: Minuteman International, Inc., Hampshire, IL (US)

( * ) Notice: Subject to any disclaimer, the term of this patent is extended or adjusted under 35 U.S.C. 154(b) by 126 days.

(21) Appl. No.: 13/317,421

(22) Filed: Oct. 18, 2011

(65) Prior Publication Data

US 2013/0095246 A1 Apr. 18, 2013

(51) Int. Cl.
*B05D 3/12* (2006.01)

(52) U.S. Cl.
USPC ..... 427/322; 427/299; 15/49.1; 15/98; 15/230.16

(58) Field of Classification Search
USPC ..... 427/322, 299; 15/49.1, 98, 230.16
See application file for complete search history.

(56) References Cited

U.S. PATENT DOCUMENTS 5,791,004 A * 8/1998 Hammadi ..... 15/98
5,839,155 A 11/1998 Berglund et al.
6,842,940 B2 1/2005 Christopher et al.
7,302,733 B2 12/2007 Rau et al.
2002/0138939 A1 10/2002 Smith et al.
2004/0093685 A1 5/2004 Clarke et al.
2006/0048331 A1 3/2006 Rau et al.
2006/0150352 A1* 7/2006 Field ..... 15/98
2009/0094784 A1* 4/2009 Pedlar et al. ..... 15/340.1
2010/0223748 A1* 9/2010 Lowe et al. ..... 15/209.1

OTHER PUBLICATIONS

Resilient Floor Care Method Bulletin 1415, 2008 Multi-Clean.

* cited by examiner

*Primary Examiner* — Timothy Meeks
*Assistant Examiner* — Nathan T Leong
(74) *Attorney, Agent, or Firm* — Greer, Burns & Crain, Ltd.

(57) ABSTRACT

A method for treating flooring not designed for sanding and having a multi-layer wax finish reduces the frequency of stripping the wax layers down to the flooring and recoating the flooring in carrying out periodic maintenance on the flooring. A mobile floor treating machine includes at least one rotating brush which is driven at a first circular speed x for cleaning the flooring and is driven at a second circular speed y for removing the two uppermost layers of wax, where y≥2x. The top remaining wax layer is then cleaned with the brush operating at the original circular speed x. Two layers of wax are then sequentially applied to the top remaining wax layer in replacing the two removed layers of wax on the floor and restoring the flooring to its original finish. The brush may be operated at 800-1500 RPM for burnishing and polishing.

5 Claims, 8 Drawing Sheets

FLOOR TREATMENT PROCEDURE

FIELD OF THE INVENTION

The present invention relates to floor care and maintenance; and in particular relates to a method for reducing the stripping frequency of a floor without degrading floor appearance and protection.

BACKGROUND OF THE INVENTION

Floor scrubbing machines of the type with which the present invention is concerned typically include at least one scrub brush mounted beneath the machine and capable of being moved by an operator (either manually, as by foot pedal, or power-assisted) between a lowered use position and a raised, transport/storage position. The brush is driven by a motor energized typically, by batteries. A source of cleaning fluid supplies the fluid to the floor or directly on the brush for scrubbing and cleaning the floor. The dirty or "spent" solution is recovered by a squeegee following behind the brush and the spent solution is removed by suction. The spent solution is stored in the machine until it is discarded, normally in a janitor's closet or the like, and the solution tank is refilled with clean solution.

Although the instant invention is not so limited, the disclosed embodiment is directed to a machine with only one brush, and for simplicity, the rear squeegee is not shown, nor are the details for delivering the clean solution and storing the spent solution because these subsystems may be conventional and do not form an essential part of the improvement of the present invention. Such conventional machines may include a circular scrub brush which is operated (typically, mechanically, by the operator's stepping on a foot pedal) between a raised (storage or transport) position, and a lowered use position. When the brush is lowered to the use position, a "run" switch is manually actuated by the operator to energize a drive motor coupled to the brush for scrubbing action.

Floor maintenance is achieved by means of the type of machine described above. Proper floor maintenance can be broken down into three broad categories which relate to the frequency, cost and labor intensity of the types of maintenance procedures. The first category involves routine floor maintenance consisting generally of dust mopping, cleaning, scrubbing or damp mopping, and burnishing or spray buffing. The goal of these activities is to improve day to day appearance of the floor, and to reduce recoating frequency and stripping frequency. The second category is restorative maintenance and involves scrubbing and recoating. The purpose of restorative floor maintenance is to reduce floor yellowing, avoid the build-up of seal and finishing layers, reduce stripping frequency, and remove imbedded dirt. Finally, the third category is renovation maintenance and involves stripping all of the layers of deposited material down to the floor surface followed by the application of sealing and finishing layers. The present invention is directed to the restorative phase of floor care in that it employs a modified scrubbing program with limited recoating and which allows for a reduction in floor stripping frequency.

OBJECTS AND SUMMARY OF THE INVENTION

Accordingly, it is an object of the present invention to reduce the frequency of floor stripping in the maintenance of floors by using a modified floor scrubbing process while maintaining attractive floor appearance and a high level of floor condition.

It is another object of the present invention to provide improved floor care employing a first RPM scrubbing routine, a second higher RPM stripping routine and a third yet higher RPM to burnish/polish using a single floor scrubbing and stripping machine.

Still another object of the present invention is to use a single mobile cleaning machine capable of operating at two rotational speeds to simplify and reduce the time required for floor care.

The present invention is directed to a method for treating floors not designed or intended for sanding and having a finish of plural layers of wax deposited thereon, where the floor is cleaned by a mobile floor cleaning machine having at least one rotating brush driven at a first circular speed x for cleaning the floor, the method comprising the steps of: removing the uppermost layers of wax from the floor by means of the rotating brush operating at a second circular speed of y, where $y \geq x$; cleaning the top remaining layer of wax by means of the rotating brush operating at the first circular speed of x; and sequentially depositing layers of wax on the top remaining layer of wax in restoring the layers of wax on the floor to the original number of layers and restoring the floor to its original finish.

Other features and advantages of the present invention will be apparent to those skilled in the art from the following detailed description of the illustrated embodiment accompanied by the attached drawings.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
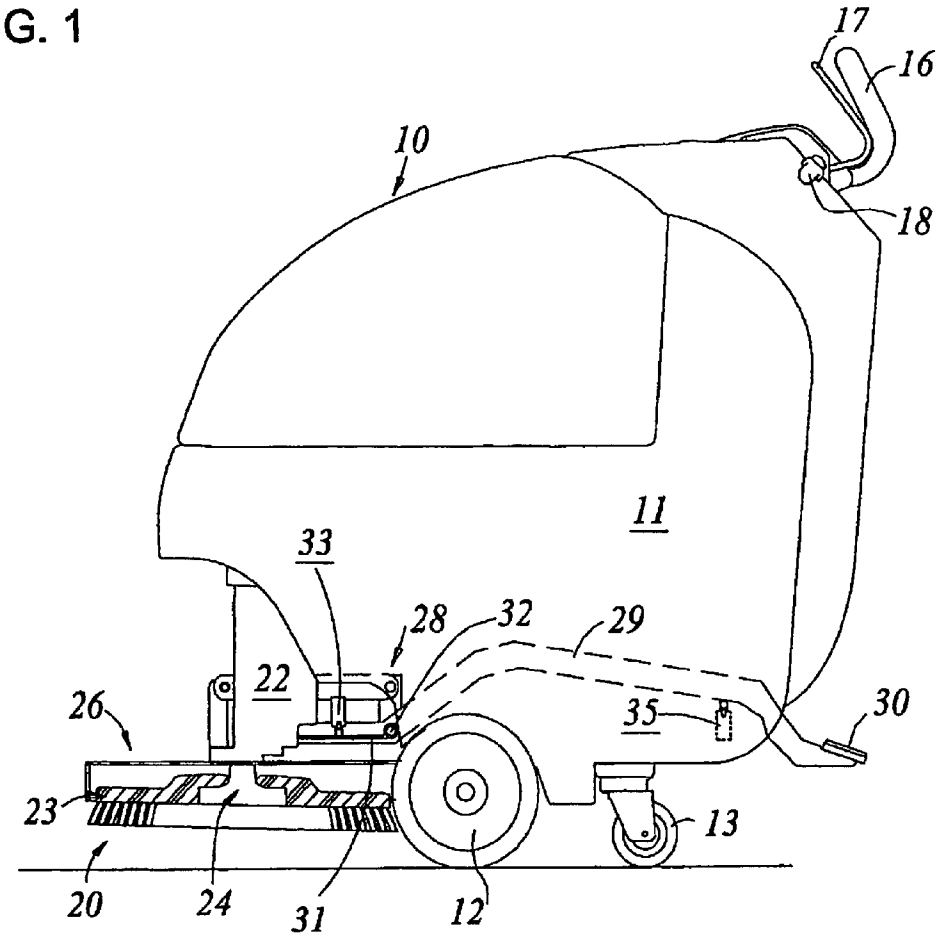
FIG. 1 is a side view of a floor scrubbing machine for carrying out the present invention, but otherwise simplified, with the brush shown in vertical cross section, and with the brush in the raised or transport position.

Referring first to FIG. 1, reference numeral 10 generally designates a typical floor scrubbing machine for carrying out the present invention. The present invention is not limited to the described machine, but may use virtually any conventional machine modified as described herein. The machine includes an outer housing or casing 11 and is supported by forward wheels 12, as well as two rear caster wheels 13. In the following description, the floor scrubbing machine is described as operating with a brush, however, the machine in carrying out the present invention may also use a conventional pad in obtaining the same results.

Within the housing 11 are batteries for powering the machine, a reservoir of cleaning fluid for application to the scrub brush or directly to the floor, with a rear suction device for recovering spent solution and a storage tank for tile spent solution, all of which are conventional and not shown in detail. While the floor scrubbing machine in the described embodiment is powered by batteries, it could equally as well be powered by an AC voltage source. However, this latter embodiment is not described for the sake of brevity and simplicity, as the cleaning machine could easily be adapted for AC operation by one skilled in the art.

An operator's handle 16 is rigidly mounted to the frame permitting the operator to maneuver the machine Forward of the handle 16 is an actuator 17, controlled by the operator, which closes an Operator Run switch 17A (See the schematic of FIG. 6) when actuated. Actuator 17 may be a manually operated bail adjacent the operator's hand, and pivotally connected to the machine so that the operator can simply squeeze the pivoting actuator handle 17 toward the fixed handle 16 to actuate the Operator Run switch (to be further described within) and power the scrub brush in the lowered position of FIG. 2.

Figure 6:
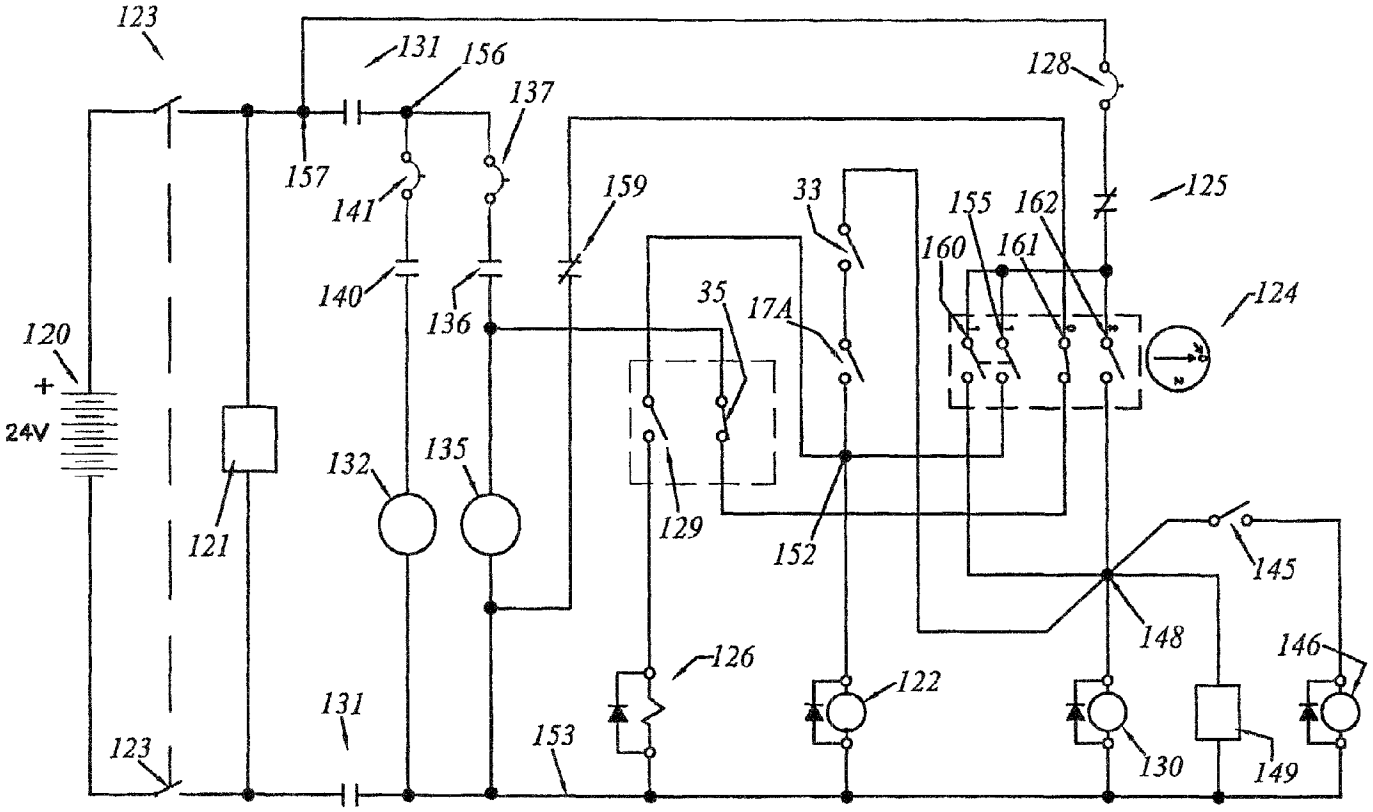
FIG. 6 is a circuit schematic diagram of the electrical control circuit for the machine of FIG. 1 in the Transport Mode.

Also mounted on the operator's console, adjacent the handle 16 (so as to be conveniently accessible to the operator) is a Keyswitch 18 (diagrammatically shown and designated 124 in the electrical schematic, FIG. 6), which is a rotary switch temporarily actuated by a key and biased to an "off" position, to be described further within. It will be appreciated, however, that the Keyswitch 18 is readily accessible to the operator when he or she is positioned at the operator's station behind the machine (to the right in FIG. 1).

Turning now to the lower forward portion of the machine, a scrub brush generally designated 20, is mounted to a drive shaft connected to a motor 22. At the lower end of the drive shaft (designated 34 in FIG. 3) there is mounted a hub assembly generally designated 24. The motor 22 is mounted above a deck 26 which houses the brush 20. The motor and deck are carried by the frame of the machine 10 by means of a lift linkage in the form of a four-bar or parallel linkage generally designated 28. A lever 29 provided with an actuating foot pedal 30 immediately in front of the operator's station is pivotally connected at 32 to the frame of the machine 10. The forward end of the lever 29 forms the lower link of the four bar linkage 28 so that when the operator depresses the foot pedal 30, the motor 22, brush 20 and deck 26 are lifted to the raised position shown in FIG. 1 for storage or transport.

Figure 2:
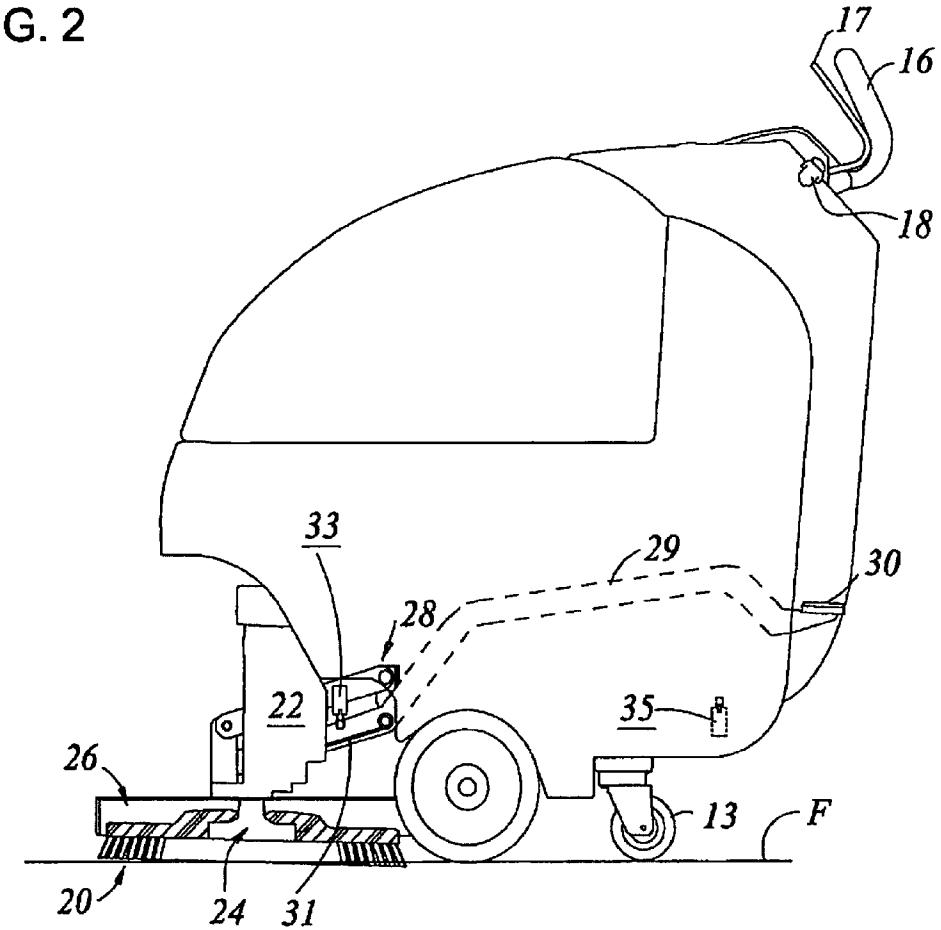
FIG. 2 is a view similar to FIG. 1, with the brush in the lowered or use position.

When the foot pedal 30 is released as seen in FIG. 2, the motor and brush are lowered by the four-bar linkage 28 to the operating position, with the bristles of the brush contacting the floor F (FIG. 2) for scrubbing. The mechanical aspects of the raise and lower mechanism, which permits the brush to be set in the biased position indefinitely, are conventional.

A Run Enable switch 33 and Brush Unload Enable switch 35 may be mounted to the frame of the machine. The functions of these switches will be described in connection with the schematic diagram, FIG. 6. The Unload Enable switch 35 is actuated by lever 29 and Run Enable switch 33 is actuated by a strike plate designated 31 in FIGS. 1 and 2. The strike plate 31 is mounted to an extension of the lever 29 which extends forwardly of the pivot 32 and which forms the lower link of the parallel linkage 28. Briefly, the Run Enable switch allows the brush to be driven by the motor when the brush is lowered for use (FIG. 2), and the Brush Unload Enable switch allows the brush to be driven for unload when the brush is in the raised position (FIG. 1).

Figure 3:
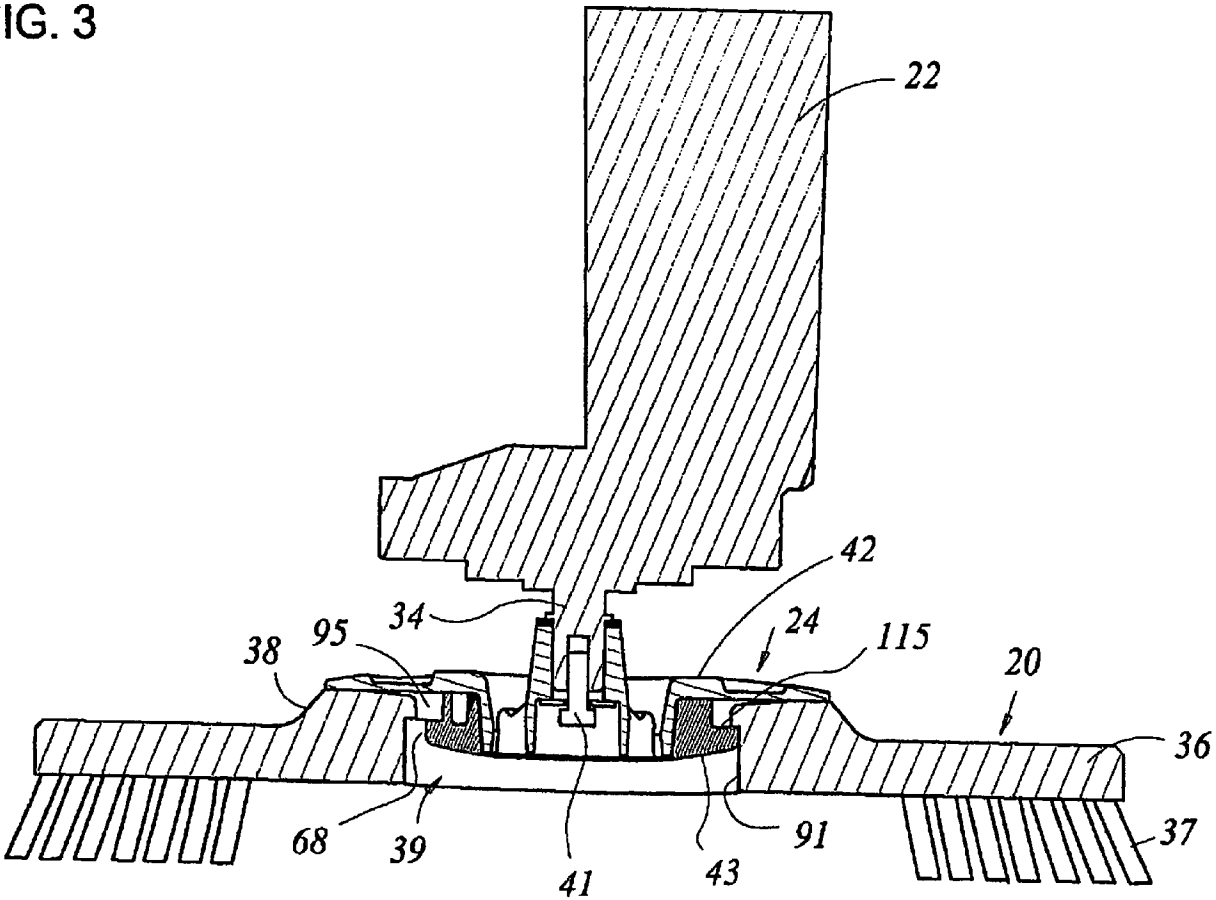
FIG. 3 is a vertical sectional view showing the motor, drive hub and brush in vertical cross section (along a plane through the axis of rotation of the brush extending in the direction of travel) and with the motor shown diagrammatically.

Turning now to FIG. 3, the motor 22 (and associated gearing, if any) is conventional and need not be described in further detail. The motor 22 drives a shaft 34 which extends in a vertical direction for driving the brush 20. The hub assembly 24 is connected to the drive shaft 34 and mounts the brush 20 as will be described in further detail.

The brush 20 includes a brush plate 36, the lower portion of which is provided with bristles 37. The center of the brush plate 36 is increased in thickness, as at 38, thus providing strength, and defining a receptacle generally designated 39 for receiving and releasably coupling to the hub assembly 24, as will be described in more detail within.

Figure 4:
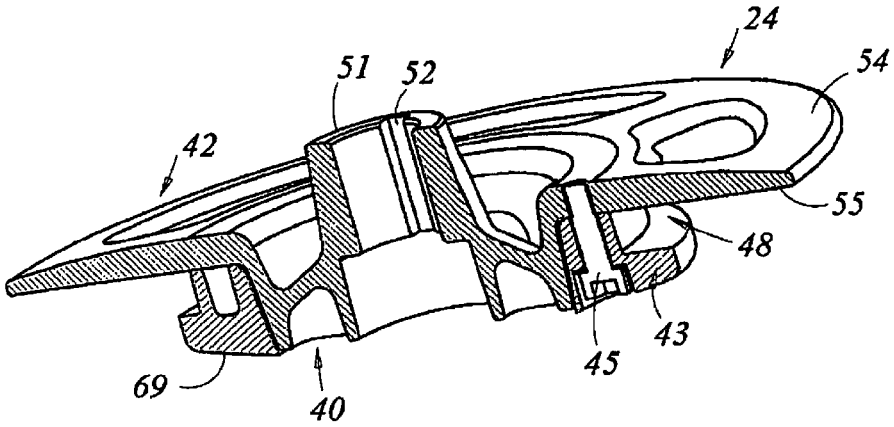
FIG. 4 is an upper perspective cross section view of the drive hub assembly.
Figure 5:
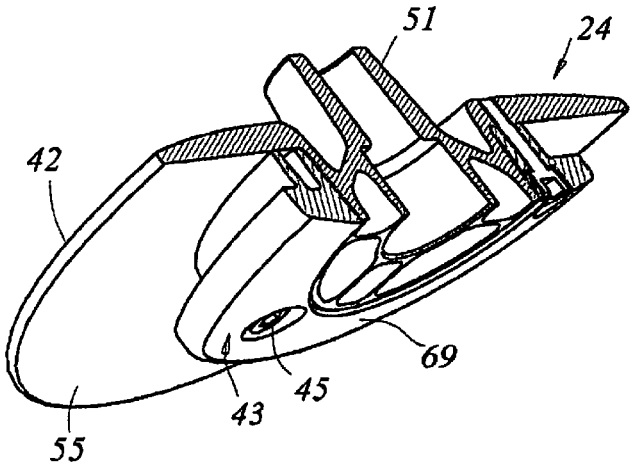
FIG. 5 is a view similar to FIG. 4, taken from a lower perspective of the drive hub.

Briefly, the hub assembly 24 includes an upper hub member 42, and a lower hub member (or "drive lug") 43. As will be described, the upper hub member 42 is placed respectively on the top of the central portion 38 of the brush 20, and the lower hub member 43 of the hub assembly 24 is located beneath the upper hub member and attached to it by means of bolts 45 (FIGS. 4 and 5). The hub assembly is fastened together by fasteners 45, and when fastened together, they grip and hold the brush plate 36 as seen in FIG. 3. The brush assembly is secure to the shaft 34 of the motor by fastener 41. As will be described, the upper hub member 24 applies the downward force on the brush 20, and the lower hub member or drive lug 43 is received in the lower, central receptacle 39 of the brush plate 36. The upper and lower hub members 42, 43 form the hub assembly 24; and they cooperate to provide an annular, circumferential retention groove or channel 48 for securing the brush 20 in the driving position of FIG. 3.

Turning now to FIGS. 4 and 5, there are shown, respectively, an upper perspective view and a lower perspective view of the drive hub assembly 24 in cross section. When the two hub members 42, 43 are secured together, by the fastener 45, they provide the retention grove or channel 48 for removably securing the brush.

Turning then to the upper hub member 42, it includes a central collar 51 which includes an axially extending key way 52 for coupling to the drive shaft 34 of the motor 22. The drive shaft 34 is provided with a matching keyway providing a driving engagement for the drive hub assembly when the upper and lower members are secured together as described above.

The upper hub member 42 also includes an outwardly extending circular flange 54 including a horizontally extending lower, generally flat lower surface 55 which extends horizontally when the hub assembly is connected to the drive shaft 34. The lower horizontal surface 55 of the upper hub member 42 rests on the upper cylindrical surface of the raised central portion 38 of the brush plate 36, and provides a means through which the upper hub member 42 exerts a downward force on the brush 20 when it is lowered to the operating position. The force may be provided by the weight of the motor 22 and the associated linkage assembly for positioning the drive motor. Additional force may be added by other means if necessary or desired.

Description of the Control Circuitry

Turning now to FIG. 6, there is shown an electrical schematic of the control circuit for operating the scrubber as has been described above. Reference numeral 120 generally designates a battery which supplies power to the unit. The battery 120 may be comprised of one or more deep cycle batteries. A battery charger 121 (operating normally-closed contacts 125) is connected across the terminals of the battery, to be plugged into a wall outlet when it is desired to charge the battery. When the battery charger is in operation, a first Keyswitch 124 is prevented from operating the system because contacts 125 open. A double-pole connector has two contacts 123, 123 connected respectively in the battery supply leads for manually disconnecting the battery for safety or testing of the circuit. Contacts 2 of first Keyswitch 124 (which is shown in electrical schematic form for switch 18 in FIG. 1, battery charger contact 125, and circuit breaker 128 are connected between junctions 157 and 148.

A brush relay designated 122 is connected in series with the normally-closed (i.e. when the brush is in the lowered position) Run Enable switch 33 and the normally-open Operator Run switch 17 A (shown in FIG. 6 in electrical schematic form) and speed control output. These four components are connected in a series circuit. One terminal of the Operator Run switch 17 A is connected to a junction 152. Two normally-open contacts 131, 131 of main relay 130 are connected respectively in the positive and negative battery leads. Keyswitch 124, which enables the operator to turn the system "on" or "off" and provides security, is connected as shown. First Keyswitch 124 is a spring biased, multiple contact switch. Briefly, switch 162 of first Keyswitch 124 is connected between junction 148 and the battery supply. Switch 161 is connected in series with normally-closed Unload Enable switch 35; switch 160 is connected to junction 148, and switch 155 (which operated with switch 160) is connected to junction 152. Contacts 125 of an internal relay of battery charger 121 are connected in series with a circuit breaker 128 and first Keyswitch 124. A main relay 130 is connected between junction 148 and battery negative. First Keyswitch 124 has three positions: Off (designated 0); On (designated 2); and Brush Unload (designated I in the drawing). When the contact (which is actuated by turning the key) moves to the numbered position, the similarly numbered contacts are actuated, as will be further described. In the Brush Unload position, first Keyswitch 124 is spring-biased to the off position and returns if released by the operator.

The upper set of normally-open contacts 131 of the main relay 130 couple power, when closed, to a junction 156. A vacuum switch 145 is connected between junction 148 and a vacuum relay 146, thus energizing a vacuum motor 132 when switch 145 is closed by the operator and junction 148 is energized.

In series with the circuit containing the brush motor 135 are normally-open contacts 136 actuated by a brush relay 122 and motor speed control output 165. A circuit breaker 137 is connected in series with the normally-open contacts 136. For reasons which will become clear, the terminals of brush motor 135 are shown as terminals 138 and 139 (which is connected to the battery negative supply line 153 when the system is in operation).

Normally-open contacts 140 (actuated by the vacuum relay 146) are connected in circuit with a circuit breaker 141 and a vacuum motor 132 for actuating the vacuum recovery system.

A vacuum switch 145, normally closed, is connected in series with the vacuum relay 146, this circuit being connected to the junction 148, as seen. A battery gauge 149 is also connected to the junction 148.

Turning to the right side of FIG. 6, the previously described Operator Run switch 17A, (bail-operated and having normally-open contacts) is connected in series with the normally-closed contacts of the Run Enable switch 33. The Run Enable switch 33 is actuated to the closed position by the strike plate 31 being in the lowered position, as seen in FIG. 2. When the Run Enable switch 33 is closed (the strike plate 31 being lowered with the brush by action of the operator), the operator may then operate the machine by actuating (via the bail 17) the Operator Run switch 17A. Junction 152 is a common junction for switch 155 of the first Keyswitch 124, the circuit comprising the Run Enable switch 33 and the Operator Run switch 17A just described; motor speed control output 165; the brush relay 122 and speed control output 163; and a series circuit comprising a water solenoid switch 129 and solenoid 126 for opening a valve to the water supply when switch 129 is closed by the operator's release of foot pedal 30.

The first Keyswitch 124 includes a set of normally-open contacts 155 which are connected to the junction 152. Normally-closed contacts 161 of the first Keyswitch 124 are connected in circuit with the normally-open Unload Enable switch 35 (shown in FIG. 6 in the closed position because FIG. 6 represents the system in the Transport Mode) which is connected to brush motor terminal 138 and speed control output 163, and normally-closed contacts 159 of the brush relay 122, which are connected to brush motor terminal 139.

Operation of the Circuitry

Normal Running Operation

The electrical schematic of FIG. 6 is shown in the transport mode. Thus, for example, the normally closed Run Enable switch 33 is shown as open in FIG. 6 and normally open Unload Enable switch 35 is shown as closed. Assuming the battery 120 is connected (switches 123 closed), when a key is inserted in first Keyswitch 124 and turned by the operator to position "2", switch 162 closes, and the battery 120 is connected through the circuit breaker 128, normally-closed contacts 125 of battery charger 121 (since battery charger 121 is not in operation) and contacts 162 of the Keyswitch 124 to the junction 148. This operates the battery gauge 149 for operator observation, and it also actuates the main relay 130.

When the main relay 130 is energized, contacts 131, 131 close, supplying power to modes 153 and 156. If the vacuum switch 145 is closed (manually), the vacuum relay 146 is energized, thereby closing the contacts 140 and energizing the vacuum motor (i.e., pump) 132.

Assuming that the brush is in the lowered or operating position, the Run Enable switch 33 is closed. This then couples power from junction 148 through the Run Enable switch 33 and the Operator Run switch 17A (when bail or actuator 17 is moved by the operator) to the junction 152. The speed control box output 163 actuates the brush relay 122 which, in turn, closes contacts 136 which turns on speed control output box 165 to energize the brush motor 135 to drive the brush 20. At the same time, the water solenoid 125 (optional) may be energized to supply water to the brush 20 because switch 129 is normally closed.

Operation continues until the operator releases the bail handle 17 which then opens the Operator Run switch 17A, thereby opening the contacts of switch 17A in FIG. 6 to de-energize the brush relay 122 and thereby, de-energize the brush motor 135.

Transport and Brush Unload

For transport, storage or brush unload (to clean, store or charge, for example), the foot pedal 30 is depressed by the operator. This raises the brush 20 to the raised position shown in FIG. 1, and the control circuit is as shown in FIG. 6. To unload the brush, the operator turns the first Keyswitch 124 to position "1", which is spring biased to return to the "OFF" or "0" position when the key is released.

When the key is in position "1", contacts 160 and 155 are closed. Contacts 155 cause the brush relay 122 to be energized via junction 152 and the speed control output box 163. This closes contacts 136 and the speed control output box 165 to energize the brush motor 135 which drives the brush in rotation (in the raised position). When the brush reaches normal speed (or even less), the operator releases the key, and the Keyswitch reverts under spring bias to position "0". In this position, contacts 155 and 160 open and contacts 161 close. This action shorts out the terminals 138, 139 of brush motor 135 via the circuit comprising: terminal 138, Unload Enable switch 35 (actuated to the closed position by virtue of manually raising the brush); closed contacts 161 (switch position "0"); and brush relay contacts 159 to motor terminal 139.

If it is desired to remove the brush the operator depresses the foot pedal 30, elevating the brush to the raised position which, in turn, closes the Unload Enable switch 35. This opens contacts 33 and closes contacts 35 of the Unload Enable switch, thereby permitting a brush removal because the brush is raised.

When the circuit is in this condition, if the operator rotates the Keyswitch 124 to the "Brush Unload" position, the contacts 155 and 160 close. This causes the main relay 130, speed control box output 163, and brush relay 122 to be momentarily energized, thereby enabling the brush motor 135 to be energized through contacts 136 (contacts 161 being open) and speed control box 165. When the operator then releases the Keyswitch 124, it returns to position "0" under spring bias. Contacts 155 and 160 open, de-energizing the brush relay 122 and main relay 130 via junction 148, thereby opening contacts 136. At the same time, contacts 161 of the Keyswitch 124 are closed, as is the Unload Enable switch 35 by the operator, thereby placing a load to decelerate motor 135 and bringing the motor to a quick stop due to the load. This permits the brush to override the drive lug and be disengaged, and to fall freely from the brush drive assembly, or to be removed manually.

While various functions of the present invention are described as being carried out by control circuitry illustrated in FIG. 6, various of these functions could be carried out by proper programming of control circuitry located in controller 204 by one skilled in the art.

Figure 7:
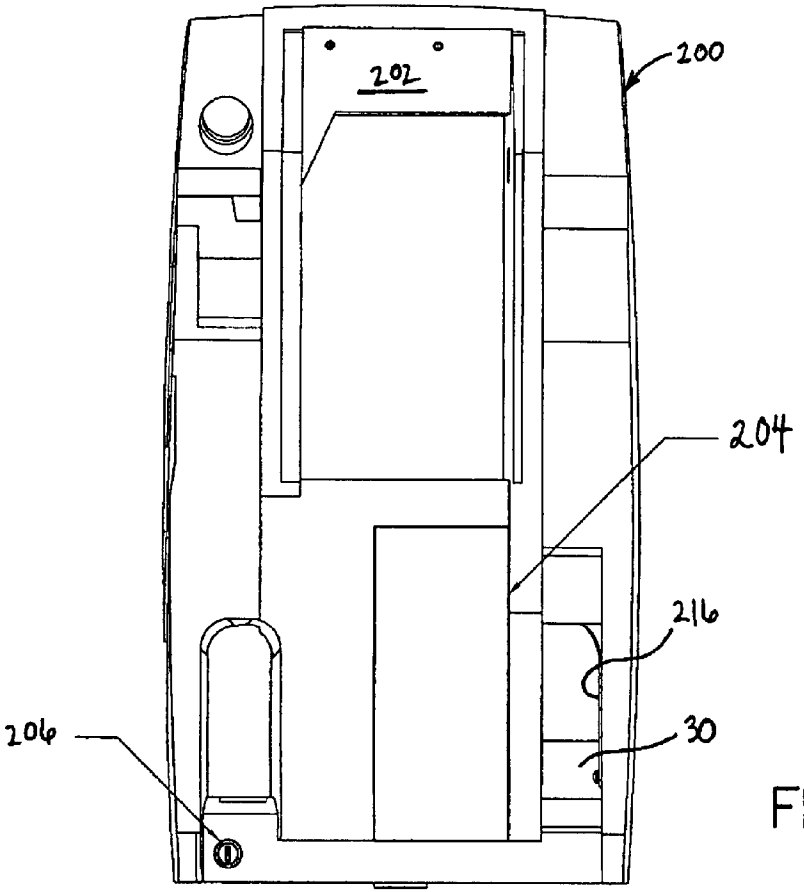
FIG. 7 is an elevation view of the rear panel of a mobile floor cleaning machine for use in carrying out the floor treatment procedure of the present invention.

Referring to FIG. 7, there is shown an elevation view of a rear panel 200 for use in a floor scrubbing machine for carrying out the present invention. Rear panel 200 includes an electrical box 202 containing the electrical circuitry illustrated in FIG. 6. Rear panel 200 further includes an aperture 216 through which pedal 30 and its associated support arm extend. Also mounted to rear panel 200 is a controller compartment 204 containing the controller used in operating the floor scrubber machine Finally, rear panel 200 includes a second Keyswitch 206 electrically connected to the electrical circuitry shown in FIG. 6 as well as to the controller within the controller compartment 204 for operating the floor scrubbing machine in accordance with the present invention.

Figure 8:
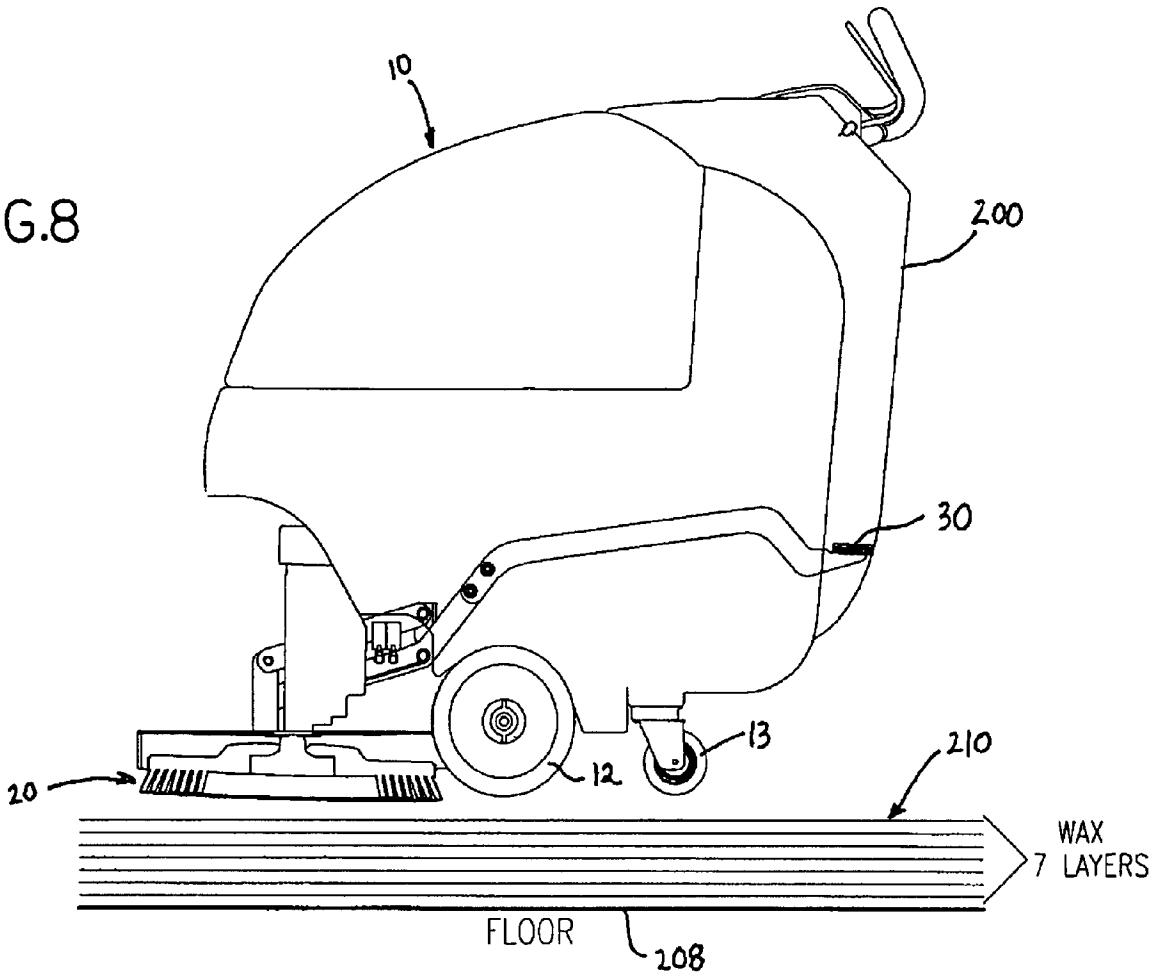
FIG. 8 is a side elevation view of a conventional floor cleaning machine in position to remove the upper wax layers of a multi-coated floor in accordance with the present invention.

Referring to FIG. 8, there is shown a side elevation view of the floor scrubbing machine 10 for use in carrying out the present invention. Floor scrubbing machine 10 includes forward wheels 12 and two rear caster wheels 13 positioned on a floor 208 upon which are deposited seven layers of wax 210. Typically on the order of seven layers of wax are applied to a floor such as in a commercial environment, although the present invention is not limited to use with floors having this number of layers of wax, as the invention can be used with virtually any number of wax layers. The thickness of the seven layers of wax 210 is illustrated in FIG. 8 as being much thicker than in an actual floor coating for purposes of illustration. Floor scrubbing machine 10 further includes at least one rotating brush 20 as previously described. Brush 20 is illustrated in FIG. 8 as being in contact with the uppermost layer of wax prior to carrying out the improved floor treatment procedure of the present invention.

Figure 9:
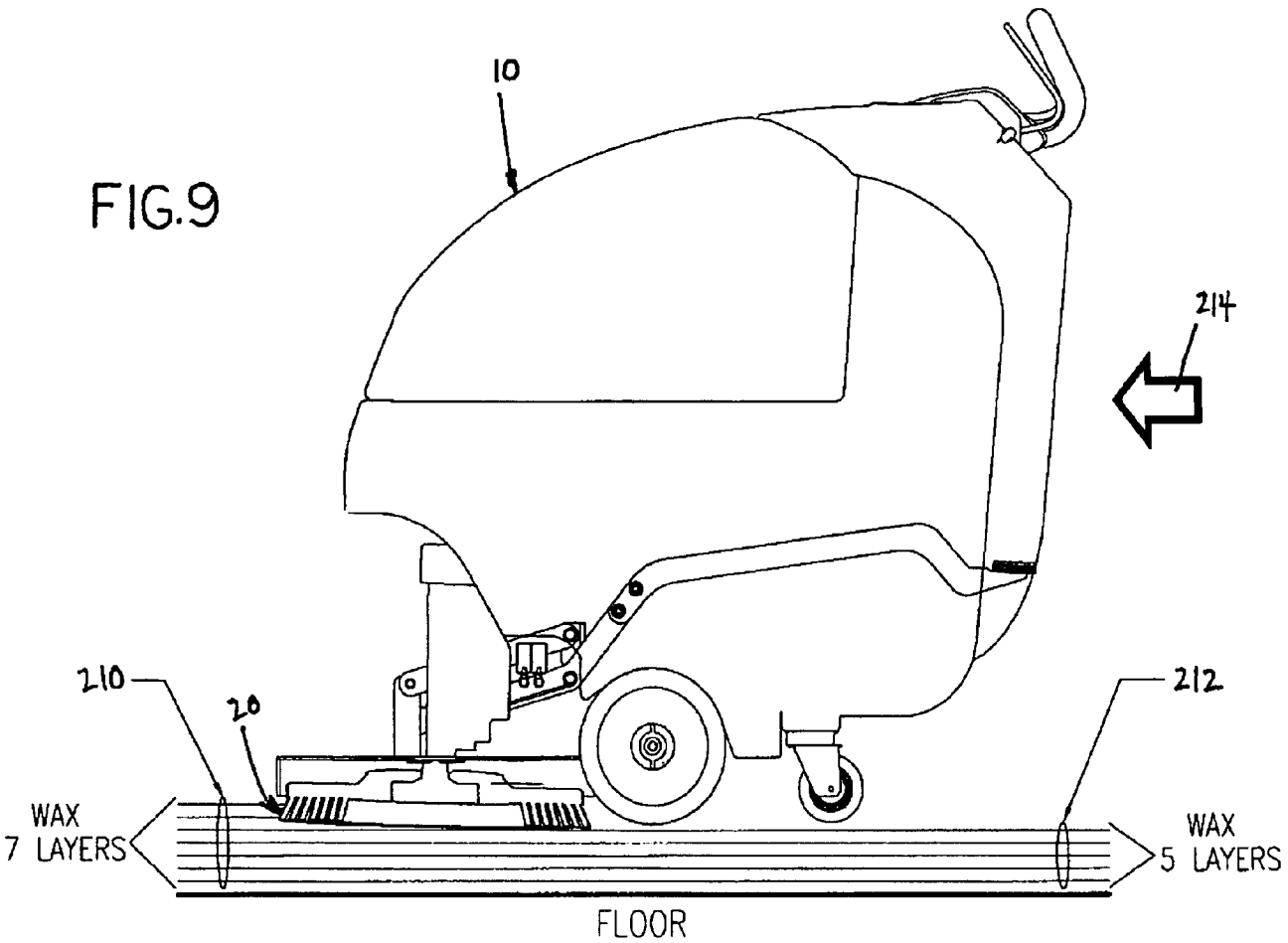
FIG. 9 is a side elevation view illustrating a floor after being stripped by the machine shown in FIGS. 8 and 9 wherein the upper several layers of the multi-layer wax coating have been removed and prepared for the resurfacing of two new wax layers.

Referring to FIG. 9, the floor scrubbing machine 10 is shown traversing the floor 208 in the direction of arrow 214. In FIG. 9, the rotational speed of the rotating brush, or brushes, 20 has been increased from approximately 180 RPM as used in the typical scrubbing operation to on the order of 400 RPM for removing the two uppermost layers of wax as the floor scrubbing machine traverses the floor 208 in the direction of arrow 214. The rotational speed is changed by moving the second Keyswitch 206 from a first position to a second position, and turning it back to the first position to return to the first lower rotational speed. The higher rotational speed of brush 20 easily removes the two uppermost layers of wax without deeply penetrating the multi-layer wax coating, leaving only five layers of wax remaining on the floor 208. Following removal of the two uppermost layers of wax, brush 20 may then be used at the lower speed of on the order of 180 RPM with the addition of clean water for cleaning and rinsing the exposed fifth layer of wax prior to sequentially applying two additional coats of wax to the remaining five layers of wax to provide the renovated floor with its original finish. In the alternative, prior to cleaning and rinsing the uppermost remaining layer of wax after the two top layers have been stripped away, the brush may be replaced with a pad for preparing the uppermost remaining wax layer for the application of two additional layers of wax. During the cleaning and rinsing process, it may be necessary to replace the pad if the accumulated removed wax becomes excessive.

In present practice, brushes and pads used in floor maintenance are color-coated to indicate their coarseness and stiffness, and, in general, the aggressiveness of the brush or pad in treating the floor surface coating. In general, maroon brushes are satisfactory for removing individual layers from a multi-layer coating of wax. After the two layers of wax are removed, the maroon brush may then preferably be replaced with a white pad which is less aggressive in its action on the floor coating. The white pad would then be used with clean water to rinse and clean the uppermost fifth layer of wax in preparation of the sequential application of two outer layers of wax to the floor's finish in restoring the floor to its original appearance and level of protection. The inventive procedure for maintaining a floor described above is particularly relevant in the case where the underlying floor is comprised of a material which is not designed, or intended, to be sanded as sanding can damage many types of floor surfaces, depending upon composition. One type of floor with which the present invention is particularly adapted for use with is a vinyl composition tile (VCT) floor.

While the present invention has been described in terms of dual speed operation, i.e., brush rotation at on the order of 180 RPM and at on the order of 400 RPM, another embodiment of the invention further contemplates operation at a third higher rotational speed on the order of 800-1500 RPM for use in burnishing and polishing operations. Referring again to the schematic diagram of FIG. 6, there is shown the combination of a first speed control box 163, a switching network 164 and a second speed control box 165. The first and second speed control boxes 163, 165 and switch network 164 control the speed of the mobile cleaning machine's brush 20. The first speed control box 163 provides a control signal to switch network 164, which provides a corresponding output signal which is provided by the first speed control box to a brush relay 122. The output of brush relay 122 is provided to the second speed control box 165. In response to the input provided by the brush relay 122 to the second speed control box 165, the second speed control box provides a corresponding output to the brush motor 135 for controlling the speed of the brush 20 of the mobile floor cleaner 10. By suitable closure and opening of the three switches within the switching network 164, the brush motor 135 is controlled so as to operate at 180 RPM, 400 RPM or 800-1500 RPM. The 180 RPM is used for cleaning of a floor, the 400 RPM speed is used for scrubbing the floor and selectively removing the upper layers of wax on the floor as described above. The 800-900 RPM speed range is used for burnishing or polishing operations on the floor. The control circuit shown in FIG. 6 may be in the form of a conventional electronic circuit as shown in this figure, or it may be incorporated in controller 204 shown in FIG. 7 on the rear panel 200 of the mobile floor cleaning machine 10. Thus, the output of the first speed control box 163 actuates relay 122 of the brush, while the output of the second speed control box 165 is a power output, the voltage of which determines at which speed the brush motor 135 operates. Additionally weight may or may not be required for any or all of these operating modes depending on the pads or brushes used.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the claims when viewed in their proper perspective based on the prior art.

What is claimed is:

1. A method for treating floors having a finish of plural layers of wax deposited thereon, where the floor is cleaned by a mobile floor treating machine having at least one rotating brush or a rotating pad driven at a first circular speed x for cleaning the floor, said method comprising the steps of:

removing the uppermost layers of wax from the floor by means of the rotating brush or pad operating at a second circular speed of y, where $y \geq 2x$;

cleaning the top remaining layer of wax by means of the rotating brush or pad operating at the first circular speed of x; and sequentially depositing layers of wax on the top remaining layer of wax in restoring the layers of wax on the floor to the original number of layers and restoring the floor to its original finish.

2. The method of claim 1 wherein the floor is comprised of vinyl.

3. The method of claim 1 wherein the step of cleaning the top remaining layer of wax includes applying water to the top remaining layer while moving the rotating brush or pad over the top remaining layer at a circular speed of 180 RPM and rinsing the water from the top remaining layer of wax.

4. The method of claim 1 wherein the original finish comprises approximately seven layers of wax.

5. A method for treating floors having a finish of plural layers of wax deposited thereon, where the floor is cleaned by a mobile floor treating machine having at least one rotating brush or a rotating pad driven at a first circular speed x for cleaning the floor, said method comprising the steps of:

removing the uppermost layers of wax from the floor by means of the rotating brush or pad operating at a second circular speed of y, where $y \geq 2x$;

cleaning the top remaining layer of wax by means of the rotating brush or pad operating at the first circular speed of x; and sequentially depositing layers on the top remaining layer of wax in restoring the layers of wax on the floor to the original number of layers and restoring the floor to its original finish;

wherein x is approximately 180 RPM and y is approximately 400 RPM.

* * * * *

UNITED STATES PATENT AND TRADEMARK OFFICE

CERTIFICATE OF CORRECTION

PATENT NO. : 8,771,794 B2
APPLICATION NO. : 13/317421
DATED : July 8, 2014
INVENTOR(S) : Pollack et al.

It is certified that error appears in the above-identified patent and that said Letters Patent is hereby corrected as shown below:

In the Claims

Column 10, Line 20, Claim 3, after "vinyl" please insert --tile--.

Signed and Sealed this
Third Day of February, 2015

Michelle K. Lee

Michelle K. Lee
*Deputy Director of the United States Patent and Trademark Office*